US012162112B2

(12) United States Patent
Wei et al.

(10) Patent No.: US 12,162,112 B2
(45) Date of Patent: Dec. 10, 2024

(54) MID-FREQUENCY ERROR-FREE MACHINING METHOD UNDER MAGNETO-RHEOLOGICAL POLISHING MAGIC ANGLE-STEP

(71) Applicant: Shanghai Institute of Optics And Fine Mechanics, Chinese Academy of Sciences, Shanghai (CN)

(72) Inventors: Chaoyang Wei, Shanghai (CN); Songlin Wan, Shanghai (CN); Jianda Shao, Shanghai (CN); Haojin Gu, Shanghai (CN)

(73) Assignee: Shanghai Institute of Optics And Fine Mechanics, Chinese Academy of Sciences, Shanghai (CN)

( * ) Notice: Subject to any disclaimer, the term of this patent is extended or adjusted under 35 U.S.C. 154(b) by 447 days.

(21) Appl. No.: 17/565,397

(22) Filed: Dec. 29, 2021

(65) Prior Publication Data

US 2022/0118577 A1 Apr. 21, 2022

Related U.S. Application Data

(63) Continuation of application No. PCT/CN2020/107306, filed on Aug. 6, 2020.

(30) Foreign Application Priority Data

Jul. 7, 2020 (CN) ..... 202010645628.2

(51) Int. Cl.
*B24B 1/00* (2006.01)
*B24B 51/00* (2006.01)

(52) U.S. Cl.
CPC ..... *B24B 1/005* (2013.01); *B24B 51/00* (2013.01)

(58) Field of Classification Search
CPC ..... B24B 1/005; B24B 51/00
See application file for complete search history.

(56) References Cited

U.S. PATENT DOCUMENTS 5,910,040 A * 6/1999 Moriyasu ..... G05B 19/4166 451/21
2006/0252354 A1 11/2006 Arana et al.

FOREIGN PATENT DOCUMENTS

CN 101250029 A 8/2008
CN 101644915 A 2/2010
(Continued)

OTHER PUBLICATIONS

He et al. Publication Jun. 20, 2017 retrieved translation from Espacenet: https://worldwide.espacenet.com/patent/search/family/059158127/publication/CN106863136A?q=pn%3DCN106863136A (Year: 2017).*

*Primary Examiner* — Steven M Cernoch
*Assistant Examiner* — Christopher Soto
(74) *Attorney, Agent, or Firm* — Mei & Mark LLP; Manni Li

(57) ABSTRACT

A mid-frequency error-free machining method under a magneto-rheological polishing magic angle-step includes the following steps: measuring a magneto-rheological removal function, and determining a control accuracy of a machine tool; performing two-dimensional Fourier transform on the removal function, performing compensating filtering on a frequency spectrum based on the control accuracy of the machine tool, and analyzing a corresponding step at the lowest point of an amplitude of the two-dimensional frequency spectrum that undergoes filtering in a direction of a magic angle; planning a grid path under the given step on the basis of adjusting a direction of a machining path or a posture of a magneto-rheological polishing wheel to allow an included angle between the polishing wheel and the path (Continued)

kept to be at the magic angle; and finally, controlling the machining of the machine tool.

2 Claims, 2 Drawing Sheets

(56) References Cited

FOREIGN PATENT DOCUMENTS

| | | | | |
|---|---|---|---|---|
| CN | 102848287 | A | | 1/2013 |
| CN | 106863136 | A | * | 6/2017 |
| CN | 109765839 | A | | 5/2019 |
| CN | 110245317 | A | | 9/2019 |
| CN | 111190386 | A | | 5/2020 |

* cited by examiner

MID-FREQUENCY ERROR-FREE MACHINING METHOD UNDER MAGNETO-RHEOLOGICAL POLISHING MAGIC ANGLE-STEP

CROSS-REFERENCE TO RELATED APPLICATIONS

The subject application is a continuation of PCT/CN2020/107306 filed on Aug. 6, 2020, which claims priority on Chinese Application No. CN202010645628.2 filed on Jul. 7, 2020, in China. The contents and subject matter of the PCT international application and Chinese priority application are incorporated herein by reference.

TECHNICAL FIELD

The present invention relates to optical polishing, particularly, a mid-frequency error-free machining method under a magneto-rheological polishing magic angle-step.

BACKGROUND ART

In the optical machining field, magneto-rheological polishing is a distinctly important machining method, which is always used as a necessary means in ultraprecision machining due to its advantages of stable removal function, weak fringe effect, and high efficiency. At present, large-aperture elements can be machined to be less than λ/10 by the magneto-rheological polishing method. However, due to relatively small removal function of a magneto-rheological tool, applying a traditional grid or an Achimedean spiral path causes significant trajectory-like mid-frequency error during machining, which is difficult to eliminate in the subsequent process, resulting in the increasing scattering rate and even self-interference of the optical elements. At present, a mainstream method for solving the problem is to implement machining along with a pseudorandom path. However, with an extremely high requirement on the rigidity and stability of a machine tool, the pseudorandom path is inappropriate for the magneto-rheological tool with a high feed rate. Therefore, it is necessary to invent a new path process, by which the mid-frequency error arising from the magneto-rheological polishing can be eliminated without increasing the requirement for the machine tool. The process has an important application on the development of the machining field.

SUMMARY OF THE INVENTION

The technical problem to be solved in the present invention is to overcome the defect of the existing magneto-rheological machining path which is prone to a mid-frequency error. A mid-frequency error-free machining method under a magneto-rheological polishing magic angle-step is provided, which eliminates the mid-frequency error by changing a path direction and a step, without influence on low and high-frequency errors. The method of the present invention improves the mid-frequency machining quality and machining efficiency and prolongs the service life of the machine tool.

The present invention provides a mid-frequency error-free machining method under a magneto-rheological polishing magic angle-step, comprising the following steps:

(1) determining a removal function R(x, y): performing a removal function test by a polishing process to extract a removal function, or using a known removal function directly;

(2) acquiring a control accuracy δ of a machine tool: reading a parameter list of the machine tool or measuring a positioning accuracy δ of the magneto-rheological machine tool;

(3) performing frequency spectrum filtering analysis: performing two-dimensional Fourier transform on the removal function R(x, y) to obtain a frequency spectrum function F(fx, fy), and filtering the frequency spectrum function by the following filtering method:

$$F(f_x, f_y) = F(R(x, y))$$

$$F_m(f_x, f_y) = \frac{2\delta f^2}{1-\delta^2 f^2} \cdot \int_{\frac{1}{1+\delta f}}^{\frac{1}{1-\delta f}} F(\eta f_x, \eta f_y) d\eta$$

$$\text{wherein } f = \sqrt{f_x^2 + f_y^2};$$

(4) determining a magic step d: analyzing a lowest amplitude position of a frequency spectrum $F_m$(fx, ft) that undergoes filtering at a magic angle θ, and when the following formula is met, determining that a corresponding included angle and a path step are optimal machining parameters, $$\min E(d) = F_m(f_x, f_y) = F_m\left(\frac{1}{d} \cdot \cos\theta, \frac{1}{d} \cdot \sin\theta\right)$$

$$\text{s.t } d \geq d_{min}, \theta = 60° \pm 10°,$$

wherein $d_{min}$ is the minimum step permissible for the machine tool;

(5) generating a magic angle-step path: according to the magic step d obtained in the previous step, keeping a line feed distance of the path at d, and keeping an included angle between a path direction and a rotary direction of a magneto-rheological polishing wheel always at an angle of θ, at the moment a path equation being expressed as:

$$\begin{cases} x_i(t) = g(i \bmod 2) \cdot t \cdot \sin\theta + i \cdot d \cdot \cos\theta - R \\ y_i(t) = g(i \bmod 2) \cdot t \cdot \cos\theta + i \cdot d \cdot \sin\theta - R \end{cases} \quad 0 \leq t \leq 2R$$

$$g(x) = \begin{cases} -1 & x = 0 \\ 1 & x = 1 \end{cases};$$

$$\text{wherein}$$

$$i = 0, 1, \ldots \frac{2R}{d},$$

each i corresponds to a grid line in the path, and R is a radius of a travel area of the path;

(6) detecting surface-shape error distribution: performing surface-shape error measurement on elements to be machined by using surface-shape detection equipment to obtain the surface-shape error distribution E(x, y);

(7) calculating distribution of residence time: sampling a path of the elements to be machined at intervals of d distance to obtain coordinates of a discrete point which serve as sampling points, and calculating the distribution of the residence time T(x, y) at the position of each sampling point based on the surface-shape error distribution E(x, y);

(8) calculating a distribution of a feed rate for machining V(x, y) according to the following formula:

$$V(x, y) = \frac{d}{T(x, y)},$$

and (9) generating a numerical control code according to an optimal path obtained in the step (4) and the distribution of the feed rate for machining V(x, y) obtained in the step (8), and then, planning a grid path under the given step on the basis of adjusting a direction of a machining path or a posture of a magneto-rheological polishing wheel to allow an included angle between the polishing wheel and the path to be at the magic angle; and finally, controlling the machine tool to implement magneto-rheological polishing on the elements to be machined.

The magic angle in the path direction, that is, the included angle θ between the path direction and the rotary direction of the polishing wheel, shall be selected within an interval of 60±10°.

The present invention has the following technical effects.

Compared with the existing technology, the residual mid-spatial frequency error obtained by the mid-frequency error-free machining method under the magneto-rheological polishing magic angle-step in the present invention is eliminated, which is greatly superior to a machining result obtained in the traditional machining path. According to the method of the present invention, the mid-frequency-free machining of the magneto-rheological tool may be realized only by modifying the control code in numerical control machining, without making any change on the machine tool, which is of great significance to improve the machining efficiency and prolong the service life of machine tool.

DETAILED DESCRIPTION OF THE INVENTION

Figure 1A:
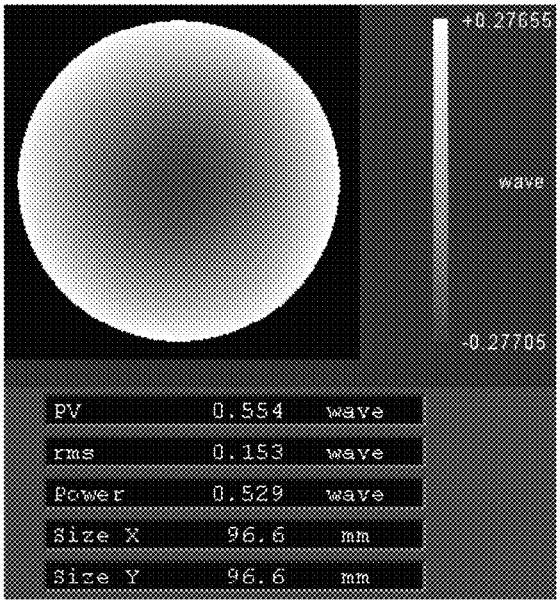
FIGS. 1A and 1B show the topography of the magneto-rheological removal function for experimental use in workpiece 1 and workpiece 2, respectively.

In one embodiment of the present invention, the parameters of the machining process of a magneto-rheological magic angle-step path are set as follows: a magneto-rheological rotation speed is 170 rpm; elements to be machined are two fused quartz plane elements with diameters of 100 mm; and a magic angle is 55.7°. In the embodiment, the two workpieces are tested in the traditional 90° path and the magic angle-step path, and machining results are compared.

A mid-frequency error-free machining method under a magneto-rheological polishing magic angle-step of the embodiment includes the following steps:

(1) a removal function R(x, y) is determined: a removal function test is performed by a polishing process to extract a removal function, or a known removal function is directly used;

(2) a control accuracy δ of a machine tool is acquired: a parameter list of the machine tool is read or a positioning accuracy δ of the magneto-rheological machine tool is measured;

(3) frequency spectrum filtering analysis is performed: two-dimensional Fourier transform is performed on the removal function R(x, y) to obtain a frequency spectrum function F(fx, fy), and the frequency spectrum function is filtered by the following filtering method:

$$F(f_x, f_y) = F(R(x, y))$$

$$F_m(f_x, f_y) = \frac{2\delta f^2}{1-\delta^2 f^2} \cdot \int_{\frac{1}{1+\delta f}}^{\frac{1}{1-\delta f}} F(\eta f_x, \eta f_y) d\eta$$

$$\text{wherein } f = \sqrt{f_x^2 + f_y^2};$$

(4) a magic step d is determined: a lowest amplitude position of a frequency spectrum $F_m$(fx, fy) that undergoes filtering at a magic angle θ is analyzed, and when the following formula is met, it is determined that a corresponding included angle and a path step are optimal machining parameters, $$\min E(d) = F_m(f_x, f_y) = F_m\left(\frac{1}{d} \cdot \cos\theta, \frac{1}{d} \cdot \sin\theta\right)$$

$$\text{s.t } d \geq d_{min}, \theta = 60° \pm 10°,$$

wherein $d_{min}$ is the minimum step permissible for the machine tool;

(5) a magic angle-step path is generated: according to the magic step d obtained in the previous step, a line feed distance of the path is kept at d, and an included angle between a path direction and a rotary direction of a magneto-rheological polishing wheel is always kept at an angle of θ, at the moment a path equation being expressed as:

$$\begin{cases} x_i(t) = g(i \bmod 2) \cdot t \cdot \sin\theta + i \cdot d \cdot \cos\theta - R \\ y_i(t) = g(i \bmod 2) \cdot t \cdot \cos\theta + i \cdot d \cdot \sin\theta - R \end{cases} \quad 0 \leq t \leq 2R$$

$$g(x) = \begin{cases} -1 & x = 0 \\ 1 & x = 1 \end{cases};$$

wherein $$i = 0, 1, \ldots \frac{2R}{d},$$

each i corresponds to a grid line in the path; and R is a radius of a travel area of the path;

(6) surface-shape error distribution is detected: surface-shape error measurement is performed on elements to be machined by using surface-shape detection equipment to obtain the surface-shape error distribution E(x, y);

(7) distribution of residence time is calculated: the path of the elements to be machined is sampled at intervals of d distance to obtain coordinates of a discrete point which serve as sampling points, and the distribution of the residence time T(x, y) at the position of each sampling point is calculated based on the surface-shape error distribution E(x, y);

(8) a distribution of a feed rate for machining V(x, y) is calculated according to the following formula:

$$V(x, y) = \frac{d}{T(x, y)},$$

and (9) a numerical control code is generated according to an optimal path obtained in the step (4) and the distribution of the feed rate for machining V(x, y) obtained in the step (8), and then, a grid path under the given step is planned on the basis of adjusting a direction of a machining path or a posture of a magneto-rheological polishing wheel to allow an included angle between the polishing wheel and the path to be at the magic angle; and finally, the machine tool is controlled to implement magneto-rheological polishing on the elements to be machined.

The magic angle in the path direction, that is, the included angle θ between the path direction and the rotary direction of the polishing wheel, shall be selected within an interval of 60±10°.

The specific steps of the embodiment are as follows:

1. The removal function is determined: surface-shape error measurement is performed on the workpieces by using surface-shape detection equipment; upon detection, the machine tool is controlled to stay for fixed time at the given positions of the workpieces; the surface-shape error is measured again; surface-shape matrix data obtained via measurements for two times are subtracted to obtain removal amount data of a magneto-rheological grinding head; and the result is divided by residence time to obtain a distribution of the removal efficiency of a magneto-rheological tool per unit time, that is, the removal function, which is expressed as R(x, y).

2. The magic step for machining of the removal function is analyzed and calculated to obtain a magic step path for machining of the removal function (the magic step of the removal function is 0.729 mm).

Figure 1B:
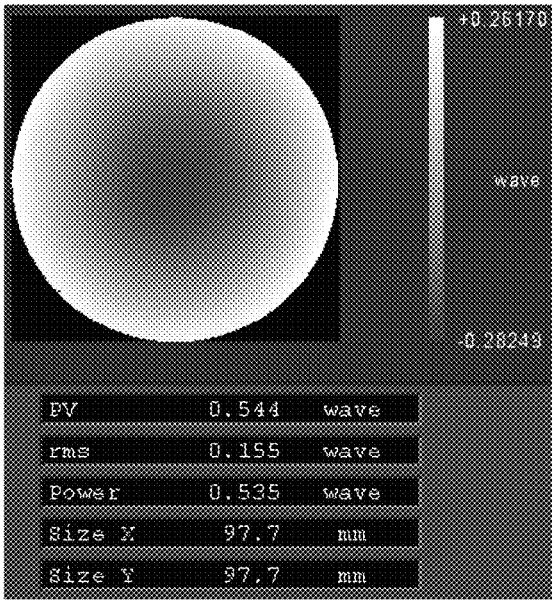

3. Initial surface-shape distributions of the two workpieces 1 and 2 are measured, which are shown in FIGS. 1A and 1B, respectively. Meanwhile, the distribution of actual residence time of machining in the two paths is calculated based on the surface-shape error.

Figure 2A:
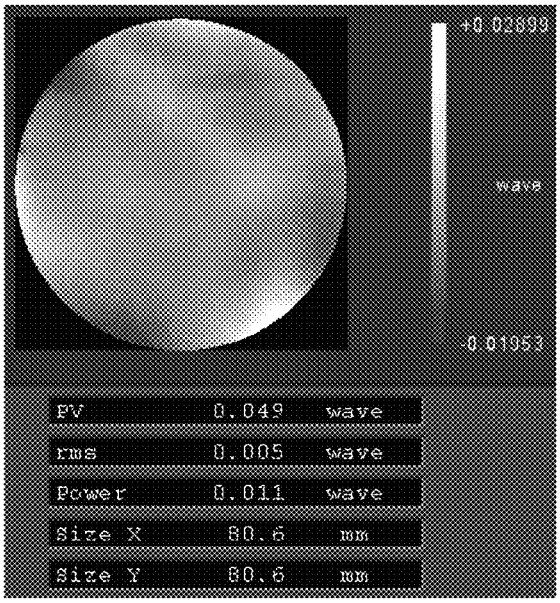
FIGS. 2A and 2B show the initial machining surface shapes of two experimental workpieces 1 and 2, respectively, in one embodiment of the present invention.
Figure 2B:
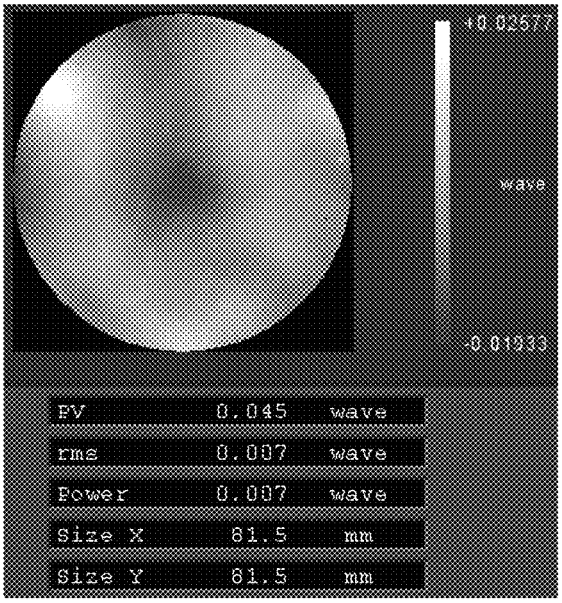

4. The two workpieces are subjected to magneto-rheological polishing respectively according to a machining process obtained by calculation, i.e., the workpiece 1 is machined in the traditional 90° path, while the workpiece 2 is machined in the magic angle-step path; and the steps of both workpieces are 0.729 mm, which are shown in FIGS. 2A and 2B, respectively. It can be seen from the figures that low-frequency errors have little difference in convergence effects under the machining in the two paths, and PVs are converged to be less than λ/20. It can be seen from the surface-shape results that the surface-shape error caused by the machining in the traditional 90° path has a significant path trajectory residue, but there is no trajectory-like mid-frequency error in a surface shape upon the machining in the magic angle-step path.

Figure 3A:
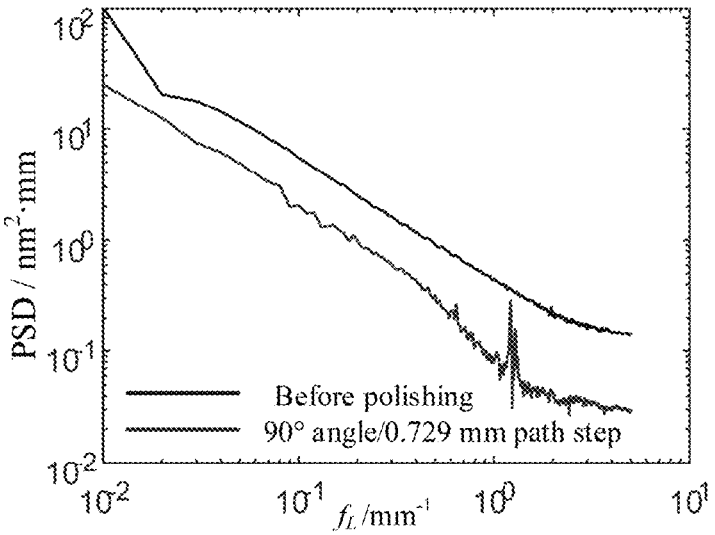
FIGS. 3A and 3B show the surface shape deviation diagram of the workpieces that are machined in a 90° traditional grid path and a magic angle-step path, wherein the workpiece 1 is machined in the 90° traditional grid path as shown in FIG. 3A, while the workpiece 2 is machined in the magic angle-step path of the present invention as shown in FIG. 3B.
Figure 3B:
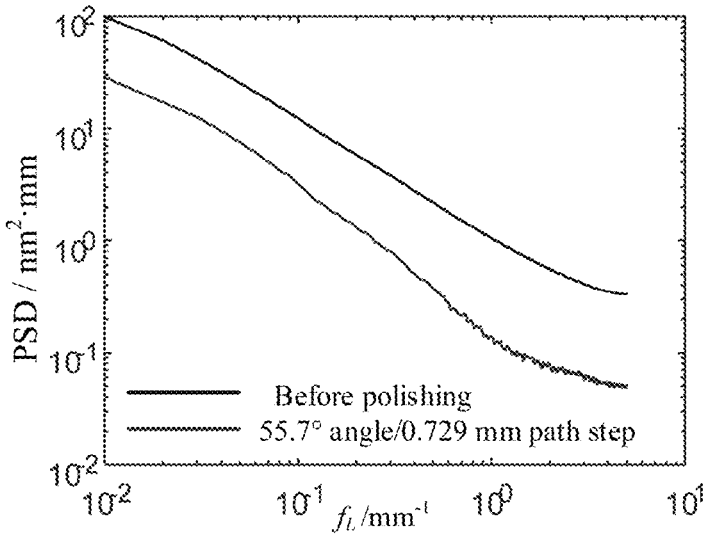

5. The surface-shape errors of both workpieces 1 and 2 are analyzed further via a frequency spectrum, which are shown in FIGS. 3A and 3B, respectively. The frequency spectrum on the top right corner is a result of an amplitude that is processed with a logarithm. There is a significant peak in surface-shape frequency spectrum information upon the machining in the traditional 90° path, representing that there is significant mid-frequency information in the surface-shape error within a path period; and a peak disappears completely in the workpiece 2, further indicating the effectiveness of the present invention. In summary, the machining results in the embodiment prove that the present invention achieves the significant actual effect.

The experiment indicates that the present invention overcomes the defect of a mid-frequency error arising from magneto-rheological equipment only by changing the path direction. The method of the present invention is conductive to improving the mid-frequency machining quality and machining efficiency, and prolonging the service life of a machine tool.

According to the machining method of the present invention, a trajectory-like mid-frequency error amplitude, theoretically, can disappear as being far lower than other machining noises only by changing an included angle between the removal function and the path, and a path step to optimal values obtained via theoretical analysis, without requiring any additional cost. The method of the present invention can implement mid-frequency error-free machining without any influence on low-frequency and high-frequency errors of elements.

We claim:

1. A mid-frequency error-free machining method under a magneto-rheological polishing angle-step, comprising:

(1) determining a removal function R(x, y) by performing a removal function test by a polishing process to extract the removal function R(x, y) or using a known removal function directly;

(2) acquiring a control accuracy δ of a machine tool by reading a parameter list of the machine tool or measuring a positioning accuracy δ of the magneto-rheological machine tool;

(3) performing frequency spectrum filtering analysis by performing two-dimensional Fourier transform on the removal function R(x, y) to obtain a frequency spectrum function F(fx, fy), and filtering the frequency spectrum function by a filtering method as follows:

$$F(f_x, f_y) = F(R(x, y))$$

$$F_m(f_x, f_y) = \frac{2\delta f^2}{1-\delta^2 f^2} \cdot \int_{\frac{1}{1+\delta f}}^{\frac{1}{1-\delta f}} F(\eta f_x, \eta f_y) d\eta$$

$$\text{Wherein } f = \sqrt{f_x^2 + f_y^2};$$

(4) determining a step d by analyzing a lowest amplitude position of a frequency spectrum $F_m$(fx, fy) that undergoes filtering at an angle θ, and when a formula as follows is met, determining that a corresponding included angle and a path step are optimal machining parameters:

$$\min E(d) = F_m(f_x, f_y) = F_m\left(\frac{1}{d}\cdot\cos\theta, \frac{1}{d}\cdot\sin\theta\right)$$
$$\text{s.t } d \geq d_{min}, \theta = 60° \pm 10°,$$

wherein $d_{min}$ is a minimum step permissible for the machine tool;

(5) generating an angle-step path by according to the step d obtained in step (4), keeping a line feed distance of the path at d, and keeping an included angle between a path direction and a rotary direction of a magneto-rheological polishing wheel always at an angle of θ, at a moment a path equation being expressed as:

$$\begin{cases} x_i(t) = g(i\bmod 2)\cdot t\cdot\sin\theta + i\cdot d\cdot\cos\theta - R \\ y_i(t) = g(i\bmod 2)\cdot t\cdot\cos\theta + i\cdot d\cdot\sin\theta - R \end{cases} \quad 0 \leq t \leq 2R$$

$$g(x) = \begin{cases} -1 & x = 0 \\ 1 & x = 1 \end{cases};$$

wherein $$i = 0, 1, \ldots \frac{2R}{d}$$

with each i corresponds to a grid line in the path; and R is a radius of a travel area of the path;

(6) detecting surface-shape error distribution by performing surface-shape error measurement on elements to be machined by using surface-shape detection equipment to obtain the surface-shape error distribution E(x, y);

(7) calculating distribution of residence time by sampling a path of the elements to be machined at intervals of d distance to obtain coordinates of a discrete point that serve as sampling points, and calculating the distribution of the residence time T(x, y) at a position of each sampling point based on the surface-shape error distribution E(x, y);

(8) calculating a distribution of a feed rate for machining V(x, y) by a formula as follows:

$$V(x, y) = \frac{d}{T(x, y)};$$

and (9) generating a numerical control code according to an optimal path obtained in step (4) and the distribution of the feed rate for machining V(x, y) obtained in step (8), and planning a grid path under the given step on the basis of adjusting a direction of a machining path or a posture of a magneto-rheological polishing wheel to allow an included angle between the polishing wheel and the path to be at the angle; and controlling the machine tool to implement magneto-rheological polishing on the elements to be machined.

2. The mid-frequency error-free machining method under the magneto-rheological polishing angle-step according to claim 1, wherein the angle in the path direction is the included angle θ between the path direction and the rotary direction of the polishing wheel and is required to be selected within an interval of 60±10°.

* * * * *